US005611412A

United States Patent [19]

Yoo et al.

[11] Patent Number: 5,611,412

[45] Date of Patent: Mar. 18, 1997

[54] ELEVATOR CAR HITCH

[75] Inventors: Young S. Yoo; Joseph C. Walker, both of Avon, Conn.

[73] Assignee: Otis Elevator Company, Farmington, Conn.

[21] Appl. No.: 499,289

[22] Filed: Jul. 7, 1995

[51] Int. Cl.[6] ..... B66B 7/10

[52] U.S. Cl. ..... 187/412; 187/254

[58] Field of Search ..... 187/251, 254, 187/411, 412

[56] References Cited

U.S. PATENT DOCUMENTS

| | | | |
|---|---|---|---|
| 1,282,374 | 10/1918 | Buckley | 187/411 |
| 1,565,646 | 12/1925 | Hobbs | 187/412 |
| 1,721,603 | 7/1929 | Neenan | 187/254 X |
| 2,214,139 | 9/1940 | Lindquist | 187/411 |
| 2,308,211 | 1/1943 | Sanford | 187/29 |
| 4,081,057 | 3/1978 | Carradini | 187/411 |
| 4,537,286 | 8/1985 | Morris et al. | 187/412 |
| 5,181,586 | 1/1993 | Yoo et al. | 187/1 |
| 5,353,893 | 10/1994 | Sun et al. | 187/412 |

FOREIGN PATENT DOCUMENTS

| | | | |
|---|---|---|---|
| 4031772 | 8/1991 | Japan | 187/411 |
| 6-239570 | 6/1994 | Japan . | |
| 7-69556 | 7/1995 | Japan . | |
| 7-137973 | 7/1995 | Japan . | |
| 897025 | 5/1962 | United Kingdom | 187/411 |

*Primary Examiner*—William E. Terrell
*Assistant Examiner*—Khoi H. Tran

[57] ABSTRACT

A hitch assembly is disclosed for an elevator car suspended by hoist ropes and driven by a drive sheave. The hitch assembly having a hitch plate with openings for thimble rods, wherein geometrical planes bisecting the openings for the thimble rods are substantially coplanar with geometrical planes bisecting hoist rope grooved recesses in the drive sheave. Another feature of the present invention is a vibration isolation assembly for fastening the hitch plate to a mounting plate fixed to the elevator car, wherein the vibration isolation assembly isolates vibrations transmitted to the elevator car from the hoist ropes. Still another feature of the hitch assembly is a rope tension equalization assembly for fastening the hoist ropes to the hitch plate, wherein the rope tension equalization assembly equalizes tensions among the hoist ropes.

13 Claims, 4 Drawing Sheets

ELEVATOR CAR HITCH

TECHNICAL FIELD

This invention relates generally to elevators, and more particularly, to a hitch assembly for suspending an elevator car from hoist ropes.

BACKGROUND OF THE INVENTION

Elevator cars are supported by wire hoist ropes that each attach at one end to the car, pass over a drive sheave and other guide sheaves, and attach at an other end to a counterweight. As the ropes pass over the drive sheave and guide sheaves, grooved recesses in the sheaves keep the hoist ropes spaced apart and ensure proper operation of the hoist system. The ropes terminate in thimble rods that attach, via a hitch plate, to the crosshead of a frame which supports the car.

Helical springs are typically mounted on the thimble rods and engage the hitch plate attached to the crosshead. The springs minimize the differences among the individual rope tensions due to variations in the groove diameters of the drive sheave and other guide sheaves, and isolate any vibrations transmitted to the carframe from the hoist ropes.

Typically, the springs used between the thimble rods and the hitch plate address both the tension equalization and the vibration isolation concerns. It is known that helical springs with small outside diameters (two inches or less) are best suited for use in equalizing rope tensions. These small outside diameters provide for a stiff spring, which is preferred for a tension equalization application. It is also known that springs of larger outer diameters (over three inches) are best suited for use in isolating vibrations from the hoist ropes. These larger outer diameter springs are less stiff than the smaller outer diameter springs, and are best suited for absorbing low frequency vibrations. Usually, the springs chosen for use between the thimble rods and the hitch plate have an outer diameter of three inches or greater. This spring size is chosen as a compromise between the tension equalization and the vibration isolation concerns.

This outer diameter of the springs necessitates that the holes in the hitch plate for the thimble rods are provided with enough space apart from each other so that the springs do not interfere with each other. However, the width spanned by this hole pattern in the hitch plate typically is larger than the width of the hoist rope grouping coming off the drive sheave and guide sheaves. Therefore, when the thimble rods are placed in the holes in the hitch plate, the hoist ropes are forced to "fan out," with the narrow portion of the fan near the sheave, and the wider portion of the fan at the hitch plate.

Beyond the use of springs, efforts have been made to further dampen the connection between the hoist ropes and the car to prevent transmittal of rope vibration and noise to the car and its occupants.

One elevator hitch assembly uses hoist ropes, thimble rods, helical springs, a hitch plate bolted to the crosshead, a compression plate, and a rubber isolation pad interposed between the compression and hitch plates. The thimble rods pass through the hitch plate, the rubber pad, and the compression plate. The rubber pad is held in place between the hitch and compression plates by bolt heads (the bolts attaching the hitch plate to the cross-head) that nest in recesses in the rubber pad. The rubber pad adds vertical elasticity to the mount assembly and retards horizontal shifting of the hitch and mounting plates relative to each other and to the thimble rods.

However, the problem with using the rubber pad in such a manner is that in order to retard horizontal shifting of the two plates, the rubber must have a relatively high hardness that inherently lessens its ability to isolate the two plates from each other to prevent transmission of vibrations from one plate to the other. The rubber pad thus cannot inherently minimize the passing of vibrations to the car.

Another solution to reduce rope induced noise and vibration includes a hitch assembly that utilizes a plurality of plates which are isolated from each other by elastomeric pads. Thimble rods pass through enlarged openings in the plates and pads, and carry helical springs which engage the lowermost of the plates. A bracket is connected to each of the plates in each pair thereof. The bracket bridges the edge of the isolation pad but does not touch it. The bracket is a thin steel sheet strip and provides a vertically resilient connection between the plates, while at the same time supplying horizontal rigidity between the plates. However, the elastomeric pad is best suited for isolating high frequency vibrations, and is not very effective for isolating low frequency vibrations.

DISCLOSURE OF THE INVENTION

It is accordingly one object of the present invention to provide a hitch assembly that reduces "fanning" of hoist ropes as they extend downward from a drive sheave to a hitch plate on an elevator car.

Another object of the present invention is to provide a hitch assembly optimized for both equalizing tensions between hoist ropes and for isolating vibrations transmitted by hoist ropes to an elevator car.

Another object of the present invention is to provide a hitch assembly with a hitch plate that is not directly fixed to a crosshead.

These objects are achieved in the present invention which comprises a hitch assembly for an elevator car suspended by hoist ropes and driven by a drive sheave, the hitch assembly having a hitch plate with openings for thimble rods, wherein geometrical planes bisecting the openings for the thimble rods are substantially coplanar with geometrical planes bisecting hoist rope grooved recesses in the drive sheave.

A feature of the present invention is a vibration isolation assembly for fastening the hitch plate to a mounting plate fixed to the elevator car, wherein through the use of springs and elastomeric materials, the vibration isolation assembly isolates vibrations transmitted to the elevator car from the hoist ropes.

Another feature of the hitch assembly is a rope tension equalization assembly for fastening the hoist ropes to the hitch plate, wherein through the use of springs, the rope tension equalization assembly equalizes tensions among the hoist ropes.

An advantage of the hitch assembly is the reduction in the "fanning" of the hoist ropes as they extend downward from the drive sheave to the hitch plate. This reduction in "fanning" lessens the tendency of the hoist ropes to rub against the edges of the grooved recesses in the drive sheave, thereby reducing wear to both the drive sheave and the hoist ropes.

Another advantage of the hitch assembly is the use of separate assemblies to both equalize the hoist ropes and to isolate hoist rope vibrations. The use of separate assemblies allows the use of optimal spring sizes in both the equalization and isolation applications, and allows for the use of springs and elastomeric materials to be used to isolate both high and low frequency vibrations.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of modifications in various respects, all without departing from the invention. Accordingly, the drawings and description are to be regarded as illustrative in nature, and not as restrictive.

BEST MODE FOR CARRYING OUT THE INVENTION

Introduction

Figure 5:
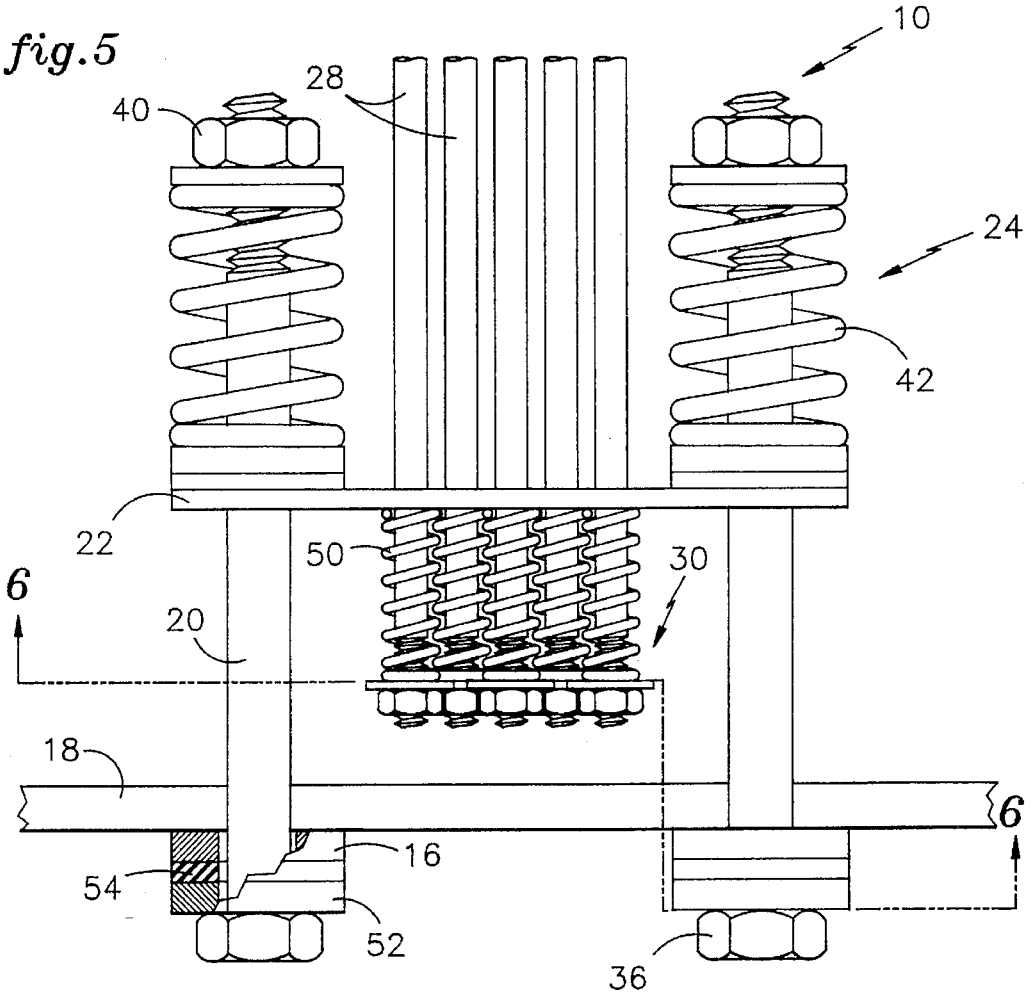
FIG. 5 is a front view, partly broken away, of a preferred embodiment of a hitch assembly of the present invention.

An embodiment of a hitch assembly 10 for use in suspending an elevator car 12 from hoist ropes 14, employing the concepts of the present invention, is illustrated in FIG. 5. Two mounting plates 16 are fastened, at symmetrical locations, to a crosshead 18 of the elevator car 12. Four support rods 20 extend upward from the mounting plates 16, and resiliently fasten to a hitch plate 22 with a vibration isolation assembly 24. The hoist ropes 14, which are driven by a drive sheave 26, terminate at the elevator car 12 with thimble rods 28. The thimble rods 28 are resiliently fastened to the hitch plate 22 with a rope tension equalization assembly 30.

Vibration Isolation Assembly

In a preferred embodiment of the present invention, two mounting plates 16 are conventionally secured to the crosshead 18 of the elevator car 12. The mounting plates 16 each are rectangular in shape, with the longer sides of the mounting plates 16 being perpendicular to the crosshead 18.

Figure 6:
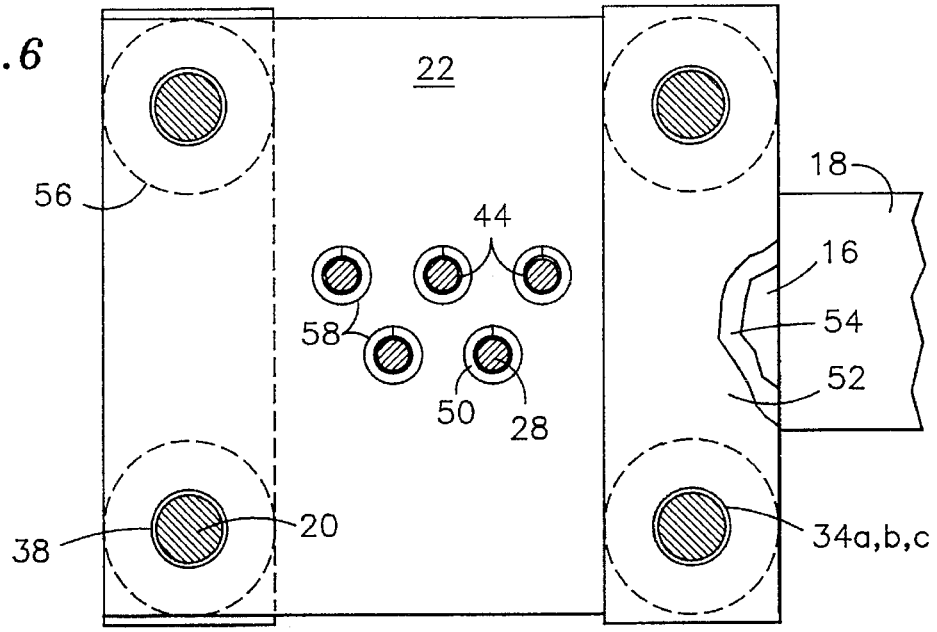
FIG. 6 is a cross-sectional view of the hitch assembly as taken along line 6—6 of FIG. 5.

As depicted in FIG. 6, each of the mounting plates 16 contains a pair of first support rod openings 34*a* located at distal portions of the mounting plates 16. These support rod openings 34*a* may be conventional bores in the mounting plates 16, wherein the bores are sized to allow the support rods 20 to pass through.

Compression plates 52 are disposed below the mounting plates 16, wherein the compression plates 52 each have a size substantially equal to the size of the mounting plates 16. The compression plates 52 have first support rod openings 34*b* that correspond with the first support rod openings 34*a* in the mounting plates 16. Interposed between the mounting plates 16 and the compression plates 52 are elastomeric pads 54. The elastomeric pads 54 each have sizes substantially equal to the size of the mounting plates 16 and the compression plates 52, wherein the elastomeric pads 54 also have first support rod openings 34*c* corresponding with the first support rod openings 34*a,b* in the mounting plates 16 and the compression plates 52.

Four support rods 20 pass through the first support rod openings 34*a,b,c* and fasten at one end to the compression plates 52. In a preferred embodiment as depicted in FIG. 5, caps 36 are fastened to the lower portions of the support rods 20, and bear against the undersurfaces of the compression plates 52.

A hitch plate 22, with two pairs of second support rod openings 38 is disposed above the mounting plates 16, wherein the second support rod openings 38 are aligned with the first support rod openings 34*a,b,c*. As with the first support rod openings 34*a,b,c*, the second support rod openings 38, may be conventional bores. The support rods 20 pass through the second support rod openings 38, with the clearances between the support rods 20 and the second support rod openings 38 being such that the hitch plate 22 is prevented from any horizontal movement.

The top portions of the support rods 20 extend through the second support rod openings 38, and terminate at upper caps 40. Support rod springs 42 are interposed between the upper caps 40 of the support rods 20, and the hitch plate 22, thereby forming a resilient buffer between the two. In a preferred embodiment, the support rod springs 42 comprises helical springs, each with an outer diameter 56 greater than three inches. The support rod springs 42 are disposed about the upper shafts of the support rods 20, with the support rod springs 42 bearing at one end against the hitch plate 22, and bearing at the opposite end against the upper caps 40 of the support rods 20.

Whereas the number of springs used in the prior art hitch assembly was limited to the number of thimble rods passing through the hitch plate, the present invention has no such limit in regard to its vibration isolation assembly. Since the vibration isolation assembly 24 uses an assembly that does not depend on the thimble rods 28, then the number of support rods 20, support rod springs 42, and elastomer pads 54, are flexible and can be varied depending on the particular application.

Drive Sheave and Hoist Ropes

Figure 1:
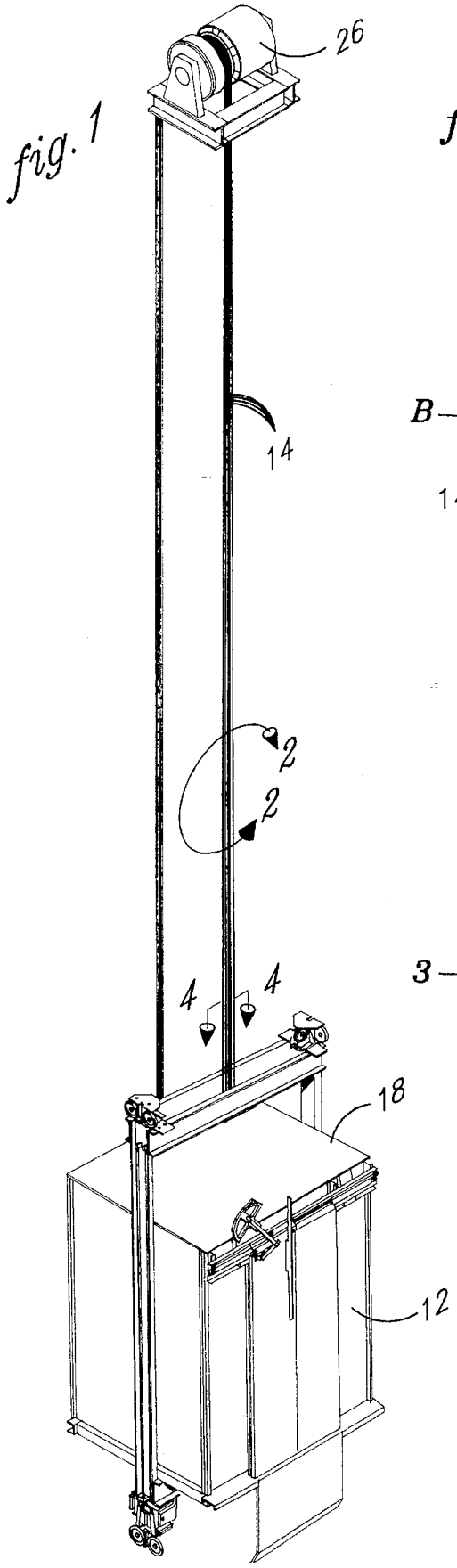
FIG. 1 is a perspective view of an elevator car suspended by hoist ropes from a drive sheave.

As depicted in FIG. 1, the hoist ropes 14 pass over the drive sheave 26, and extend downward to the elevator car 12 on one side, and to the counterweight (not shown) on the other side. The hoist ropes 14 terminate at the elevator car 12 with conventional thimble rods 28.

Figure 1A:
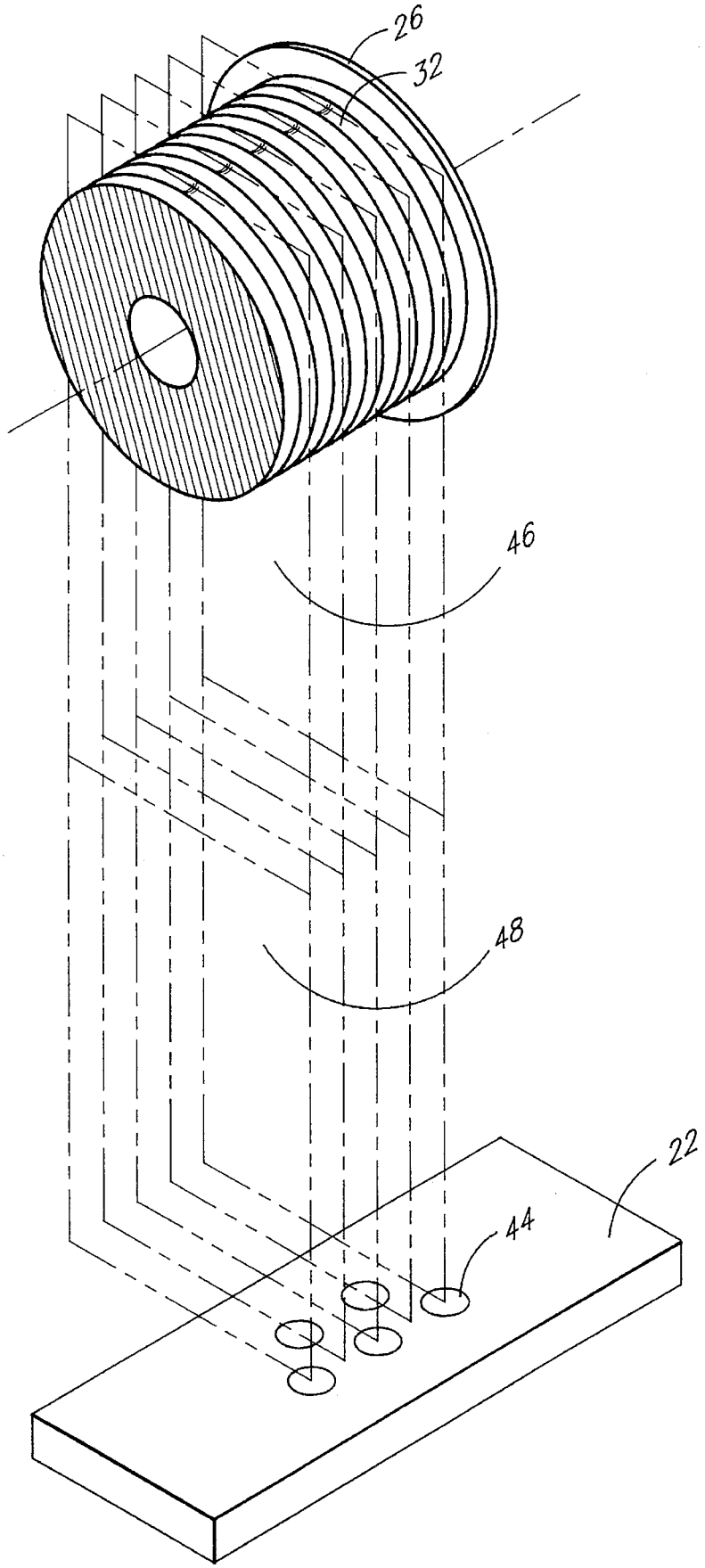
FIG. 1A is a sectional perspective view of the drive sheave of FIG. 1, with geometrical planes added for reference between the drive sheave and a hitch plate.

As depicted in FIG. 1A, the portion of the drive sheave 26 over which the hoist ropes 14 pass, contains a plurality of grooved recesses 32. For illustrative purposes, first geometric planes 46 are provided, wherein these first planes 46 bisect each of the grooved recesses 32 and extend downward toward the hitch plate 22.

Rope Tension Equalization Assembly

As depicted in FIG. 6, the hitch plate 22 contains a plurality of thimble rod openings 44, wherein the number of thimble rod openings 44 corresponds to the number of hoist ropes 14. Each of the thimble rods 28 on the hoist ropes 14 has a corresponding thimble rod opening 44 through which the thimble rod 28 may pass through.

Figure 2:
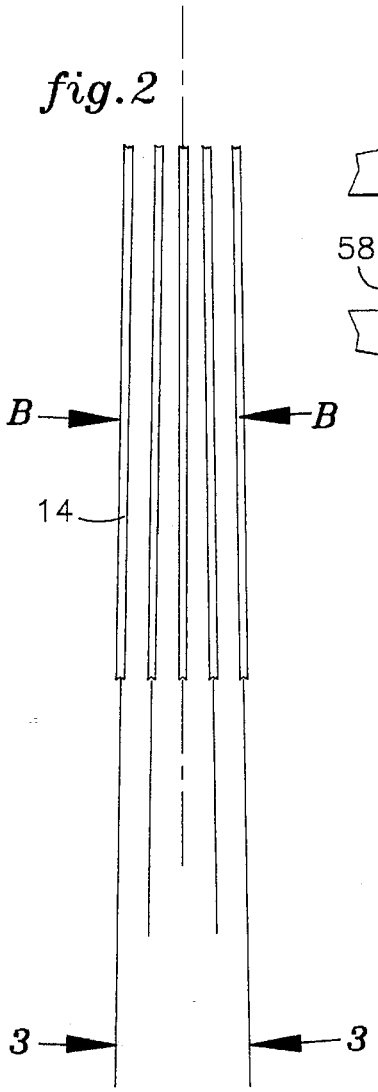
FIG. 2 is an enlarged sectional view of the hoist ropes taken along line 2—2 of FIG. 1.

As depicted in FIG. 1A, the locations of the thimble rod openings 44 along the length of the hitch plate 22 are best described by the illustrative use of second geometrical planes 48. Each of these second planes 48 bisects each of the thimble rod openings 44 along axes substantially parallel to the first planes 46. The position of each thimble rod opening 44 is at a point where the second plane 48 bisecting each thimble rod opening 44 is substantially coplanar with a corresponding first plane 46 bisecting one of the grooved recesses 32 of the drive sheave 26. Each of the thimble rod openings 44 is substantially vertically aligned along one plane with each of the grooved recesses 32 in the drive sheave 26. Therefore, as depicted in FIG. 2, the grouping of hoist ropes 14 between the drive sheave 26 and the hitch plate 22 has a substantially uniform width B from the drive sheave 26 to the hitch plate 22, thereby minimizing the aforementioned "fanning" effect.

Figure 3:
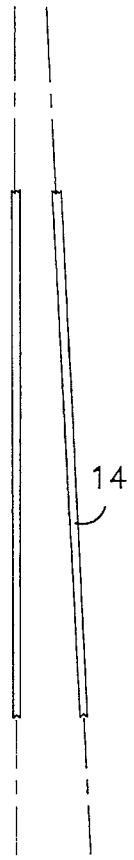
FIG. 3 is a view of the hoist ropes taken along line 3—3 of FIG. 2.

It is desirable to reduce the "fanning" of the hoist ropes as they descend from the drive sheave to the hitch plate, as found with the prior art hitch assemblies, because "fanning" causes excessive wear to both the hoist ropes and the drive sheave. Since the grooved recesses on the drive sheave are aligned in parallel along the outer circumference of the drive sheave, if the hoist ropes are forced to skew outward from these grooved recesses, then this will create lateral forces on the grooved recesses. Upon repeated rotation of the drive sheave, the friction caused by these lateral forces will result in wear to the portions of the hoist ropes pressing against the sides of the grooved recesses, in addition to causing wear to the grooved recesses themselves. This type of excessive wear is undesirable since it is both expensive, and time consuming, to repair or replace the hoist ropes or the drive sheave. Although the hoist ropes 14 do "fan" within the planes 46,48, as depicted in FIG. 3, the fanning within these planes 46,48 does not press the hoist ropes 14 against the side edges of the grooved recesses 32, and therefore does not cause the same wear to the drive sheave 26 and hoist ropes 14 as the sideways "fanning" found in the prior art.

The diameters of the thimble rods 28 and thimble rod openings 44 are selected so that the thimble rods 28 can pass through the thimble rod openings 44, while having enough clearance about the circumference of the thimble rods 28 to prevent the thimble rods from touching the inner surfaces if the thimble rod openings 44. This clearance ensures that as the hoist ropes 14 cause the thimble rods 28 to vibrate, this vibration will not be transmitted directly to the hitch plate 22 through the thimble rod openings 44.

Figure 4:
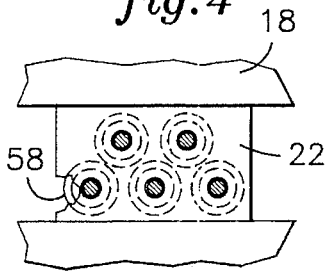
FIG. 4 is a cross-sectional view of a hitch plate fixed to a crosshead, taken along line 4—4 of FIG. 1.

To equalize uneven tensions among the hoist ropes 14, thimble rod springs 50 are interposed between the ends of the thimble rods 28 and the hitch plate 22. In a preferred embodiment of the present invention, helical springs with an outer diameter 58 of two inches are used as the thimble rod springs 50. Helical springs of this size outer diameter 58 provide enough stiffness to properly maintain substantially equal tensions among the hoist ropes 14. In addition, as depicted in FIG. 4, the use of springs with small outer diameters 58 allows the thimble rod openings 44 to be placed close enough together to decrease the "fanning" seen in the prior art hitch assemblies.

Hitch Assembly Operation

In operation, as the elevator car 12 translates up and down through a hoistway (not shown) by the drive sheave 26, the hitch assembly 10 of the present invention acts to equalize tensions among the hoist ropes 14, and to isolate vibrations transmitted to the elevator 12 from the hoist ropes 14.

Since the elevator car 12 is suspended by the hoist ropes 14, the weight of the elevator car 12 acts to pull down against these hoist ropes 14. This downward force causes the thimble rod springs 50 in the rope tension equalization assembly 30 to compress. If there are unequal tensions amongst the hoist ropes 14, then due to the gravitational forces on the elevator car 12, each of the thimble rod springs 50 will compress a different amount, keeping the hitch plate 22 and the elevator car 12 level.

Vibrations transmitted to the hitch plate 22 through the thimble rods 28 are then transmitted to the vibration isolation assembly 24. As the hitch plate 22 vibrates up and down from vibrations transmitted to the hitch plate 22 from the hoist ropes 14, the support rod springs 42 and the elastomeric pads 54 act to isolate these vibrations and prevent their transmittal through the support rods 20 to the mounting plate 16 and then onto the crosshead 18 of the elevator car 12. The support rod springs 42 act to isolate low frequency vibrations, while the elastomeric pads 54 act to isolate the high frequency vibrations.

The low frequency vibrations are isolated as the hitch plate 22 moves up and down relative to the top caps 40 of the support rods 20, thereby compressing the support rod springs 42. The high frequency vibrations are isolated as the lower cap 36 of the support rods 20, press upward against the compression plates 52, thereby compressing the elastomeric pads 54 between the compression plates 52 and the mounting plates 16.

In operation, the vibration isolation assembly 24 and the rope tension equalizatiop assembly 30 act simultaneously to provide a smooth, stable, and low vibrational trip of the elevator car 12 through the hoistway. The prior art hitch assemblies do not effectively isolate both high frequency and low frequency vibrations. The present hitch assembly 10 provides for means to effectively isolate both the high frequency and low frequency vibrations transmitted to the elevator car 12 from the hoist ropes 14, while not compromising the ability of the hitch assembly 10 to separately equalize tensions among the hoist ropes 14.

Alternative Embodiments

It will be readily seen by one of ordinary skill in the art that the present invention fulfills all the objects set forth above. After reading the foregoing specification, one of ordinary skill will be able to effect various changes, substitutions of equivalents and various other aspects of the invention as broadly disclosed herein.

Figure 7:
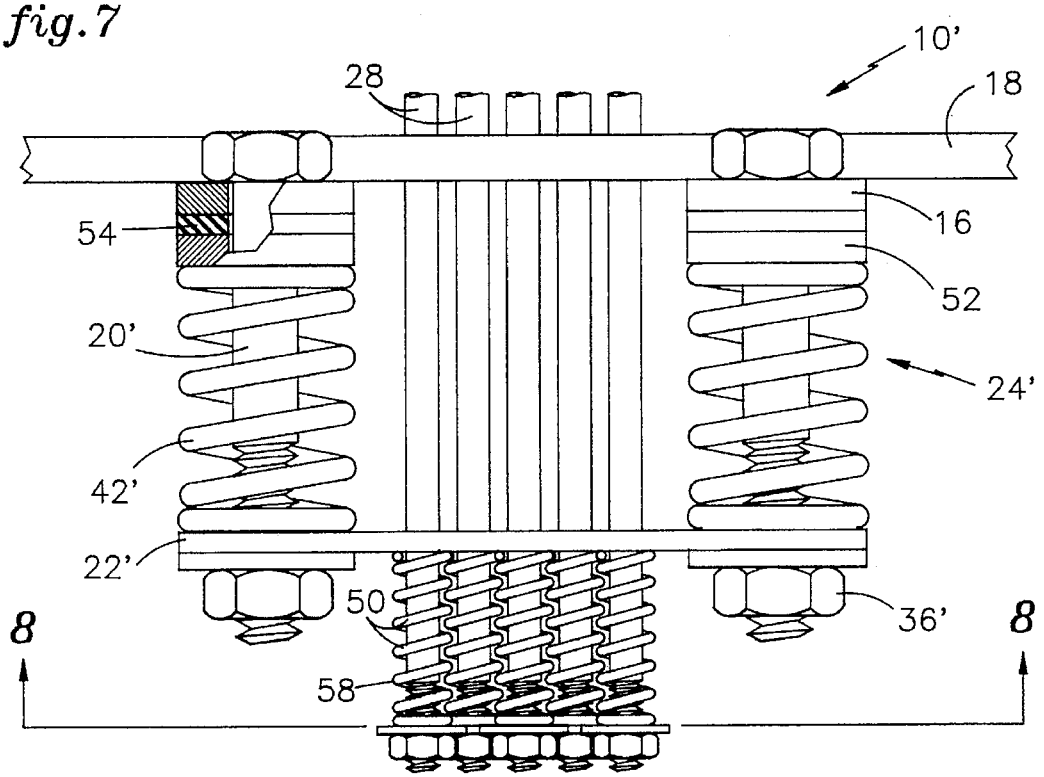
FIG. 7 is a front view, partly broken away, of an alternative embodiment of a hitch assembly of the present invention.
Figure 8:
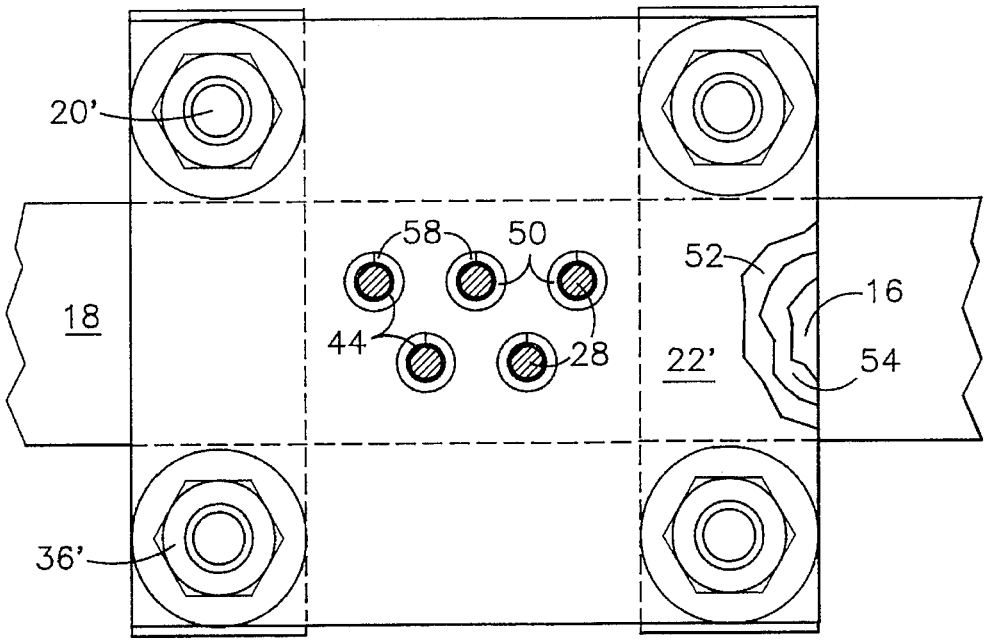
FIG. 8 is a cross-sectional view of the hitch assembly as taken along line 8—8 of FIG. 7.

An alternative embodiment of the present invention 10' is depicted in FIGS. 7 and 8. In this alternative embodiment 10', the hitch plate 22' is disposed below the mounting plates 16, and below the crosshead 18. The compression plates 52 are still located below the mounting plates 16, with the elastomeric pads 54 interposed between the compression plates 52 and the mounting plates 16. In this embodiment, the support rods 20' extend downward, with the hitch plate 22' sitting against the lower caps 36' of the support rods 20'. Support rod springs 42' are interposed between the compression plates 52 and the hitch plate 22'. This alternative embodiment 10' performs the vibration isolation and tension equalization functions in a like manner as the preferred embodiment.

In alternative embodiments, the location of the hitch plate 22 may be above or below the mounting plates 16. Likewise, the corresponding support rods 20 may be located above or below the mounting plates 16 in order to secure the hitch plate 22 to the mounting plates 16. The size, number, and shape of the hitch plate 22 is not limited to the preferred embodiment unitary hitch plate 22. In alternative embodiments, the number of hitch plates 22, and the shape of the hitch plate 22 may vary, and may not have support rod openings for the support rods 20. Additional plates may be used to provide upper support rod openings, with the hitch plate 22 only having thimble rod openings 44. The hitch plate 22 may be positioned so that it may press against these additional plates in order for the vibration isolation assembly 24 to function.

The number of mounting plates 16 is not limited to two. There may be more or less than two mounting plates 16 used in the hitch assembly 10. The mounting plates 16 are not limited to rectangular shapes, and may take on any shape or spatial orientation on the crosshead 18. Similarly, the compression plates 52 may vary in number, shape, and orientation, and may not necessarily be limited by the features of the mounting plates 16.

The elastomeric pads 54 may be disposed in discrete locations on the support rods 20, or may be applied as one piece throughout the vibration isolation assembly 24. In an alternative embodiment, the elastomeric pads 54 may utilize the prior art hitch plate isolation assembly using clamps to prevent the mounting plates 16 and the compression plates 52 from moving horizontally. The material chosen for the elastomeric pads 54 may be rubber, silicon elastomer, dupont Neoprene, butyl, or any other elastomeric material capable of isolating vibrations, and in particular, high frequency vibrations.

In alternative embodiments, the support rod springs 42 may be helical springs of various sizes, may utilize multiple springs, may use springs other than helical, may employ a combination of springs and elastomeric materials, may be metal springs, plastic springs, or any form of spring-like assembly that can isolate vibrations, and in particular, low frequency vibrations. Although it is preferred that the support rod springs 42 should have an outer diameter of three inches or greater, the support rod springs 42 may have an outer diameter less than this preferred range.

In alternative embodiments, the thimble rod springs 50 may be helical springs of various sizes, may utilize multiple springs, may use springs other than helical, may employ a combination of springs and elastomeric materials, may be metal springs, plastic springs, or any form of spring-like assembly that can equalize hoist rope tensions. Although it is preferred that the thimble rod springs 50 should have an outer diameter of two inches, the thimble rod springs 50 may have an outer diameter greater or less than this preferred number.

Although in the preferred embodiment, the hoist ropes 14 descend from the drive sheave 26 to the hitch plate 22, the present invention will also function properly if the hoist ropes 14 descend downward from a deflector sheave or a guide sheave to the hitch plate 22. In addition, the present invention may also be used with a counterweight in an elevator system instead of an elevator car 12. In that application, the mounting plates 16 may be fastened to a part of the counterweight instead of the crosshead 18 of the elevator car 12.

Various changes to the above description may be made without departing from the spirit and scope of the present invention as would be obvious to one of ordinary skill in the art of the present invention. It is intended that the protection granted hereon be limited only by the definition contained in the appended claims and equivalents thereof.

What is claimed is:

1. In an elevator system having a plurality of ropes disposed within a plurality of grooved recesses in a drive sheave, each of said grooved recesses being bisected by first planes, said first planes being in parallel, a hitch assembly for suspending an elevator car from said ropes, said hitch assembly comprising:

(a) a mounting plate attaching to said elevator car;

(b) a hitch plate, said hitch plate having a plurality of thimble rod openings, each of said thimble rod openings being bisected by second planes, each of said second planes corresponding and being substantially coplanar with each of said first planes, said hitch plate having an undersurface;

(c) a vibration isolation assembly for attaching said hitch plate to said mounting plate, said vibration isolation high and low frequency assembly isolating vibrations transmitted to said elevator car from said ropes; and (d) a rope tension equalization assembly for attaching said ropes to said hitch plate, said rope tension equalization assembly facilitating the equalization of tensions among said ropes, said rope tension equalization assembly comprising a plurality of thimble rods attached to said ropes, said thimble rods extending through said thimble rod openings in said hitch plate, said thimble rods being sized so as to be free of contact with said hitch plate in said thimble rod openings, each of said thimble rods being connected to a respective thimble rod spring means which bears against said undersurface of said hitch plate.

2. A hitch assembly as claimed in claim 1, wherein said vibration isolation assembly comprises:

(a) a plurality of first support rod openings in said mounting plate;

(b) a plurality of second support rod openings in said hitch plate, said second support rod openings corresponding to said first support rod openings;

(c) a plurality of support rods extending through said first support rod openings and said second support rods openings, each of said support rods having a first end portion and a second end portion, said first end portions being fastened to said mounting plate, and (d) said support rod spring means interposed between said hitch plate and said second end portion of each of said support rods.

3. A hitch assembly as claimed in claim 2, further comprising:

a plurality of said mounting plate.

4. A hitch assembly as claimed in claim 1, wherein said vibration isolation assembly comprises:

(a) a plurality of first support rod openings in said mounting plate;

(b) a plurality of second support rod openings in said hitch plate;

(c) a compression plate;

(d) a plurality of third support rod openings in said compression plate;

(e) elastomeric means, said elastomeric means being interposed between said mounting plate and said compression plate;

(f) fourth said support rod openings in said elastomeric means, said first support rod openings, said second support rod openings, said third support rod openings, and said fourth support rod openings being vertically aligned;

(g) a plurality of support rods extending through said support rod openings, each of said support rods having a first end portion and a second end portion, said first end portions being fastened to said compression plate; and (h) support rod spring means disposed about each of said support rods, each of said support rod spring means being interposed between said hitch plate and said second end portions of said support rods.

5. A hitch assembly as claimed in claim 4, further comprising:

a plurality of said mounting plate.

6. A hitch assembly as claimed in claim 4, further comprising:

a plurality of said compression plate.

7. A hitch assembly as claimed in claim 4, further comprising:

a plurality of said elastomeric means.

8. A hitch assembly as claimed in claim 1, wherein said vibration isolation assembly comprises:

(a) a plurality of first support rod openings in said mounting plate;

(b) a plurality of second support rod openings in said hitch plate, said second support rod openings being vertically aligned with said first support rod openings;

(c) a plurality of support rods extending through said first support rod openings and second support rod openings, each of said support rods having a first end portion and a second end portion, said first end portions being fastened to said hitch plate, said second end portions being fastened to said mounting plate; and (d) said support rod spring means disposed about each of said support rods, each of said support rod spring means being interposed between said hitch plate and said mounting plate.

9. A hitch assembly as claimed in claim 8, further comprising:

a plurality of said mounting plate.

10. A hitch assembly as claimed in claim 1, wherein said vibration isolation assembly comprises:

(a) a plurality of first support rod openings in said mounting plate;

(b) a plurality of second support rod openings in said hitch plate, (c) a compression plate;

(d) a plurality of third support rod openings in said compression plate, (e) elastomeric means, said elastomeric means being interposed between said mounting plate and said compression plate;

(f) a plurality of fourth support rod openings in said elastomeric means, said first support rod openings, said second support rod openings, said third support rods openings, and said fourth support rod openings being vertically aligned;

(g) a plurality of support rods extending through said support rod openings, each of said support rods having a first end portion and a second end portion, said first end portions being fastened to said hitch plate said second end portions being fastened to said mounting plate; and (h) said support rod spring means disposed about each of said support rods, each of said support rod spring means being interposed between said compression plate and said mounting plate.

11. A hitch assembly as claimed in claim 10, further comprising:

a plurality of said mounting plate.

12. A hitch assembly as claimed in claim 10, further comprising:

a plurality of said compression plate.

13. A hitch assembly as claimed in claim 10, further comprising:

a plurality of said elastomeric means.

* * * * *